US006003786A

United States Patent [19]

Schwary

[11] Patent Number: 6,003,786

[45] Date of Patent: Dec. 21, 1999

[54] HIGH SPEED WATER SHEET TOOL

[76] Inventor: Richard L. Schwary, P.O. Box 1155, Camas, Wash. 98607

[21] Appl. No.: 09/052,055

[22] Filed: Mar. 30, 1998

Related U.S. Application Data

[63] Continuation-in-part of application No. 08/919,860, Aug. 27, 1997, abandoned

[60] Provisional application No. 60/042,181, Apr. 2, 1997.

[51] Int. Cl.[6] ..... B05B 7/30; A62C 31/02

[52] U.S. Cl. ..... 239/310; 239/318; 239/390; 239/397; 239/588

[58] Field of Search ..... 239/310, 318, 239/390, 397, 518, 521, 569, 588

[56] References Cited

U.S. PATENT DOCUMENTS

| | | | |
|---|---|---|---|
| 2,316,781 | 4/1943 | Fox | 239/310 |
| 2,795,460 | 6/1957 | Bletcher et al. | 239/310 X |
| 2,921,488 | 1/1960 | Davis | 239/521 X |
| 2,965,309 | 12/1960 | Parrott | 239/310 |
| 3,099,394 | 7/1963 | Lynn | 239/310 X |
| 3,122,325 | 2/1964 | Mahrt et al. | 239/318 |
| 3,228,613 | 1/1966 | Goldstein | 239/318 |
| 3,829,023 | 8/1974 | Bouillard et al. | 239/318 |
| 5,054,159 | 10/1991 | Richardson | 15/400 |
| 5,529,242 | 6/1996 | Hedin | 239/521 X |

FOREIGN PATENT DOCUMENTS

| | | | |
|---|---|---|---|
| 1320124 | 1/1963 | France | 239/318 |
| 608422 | 3/1959 | Italy | 239/318 |
| 3788 | of 1910 | United Kingdom | 239/521 |

*Primary Examiner*—Andres Kashnikow
*Assistant Examiner*—Robin O. Evans
*Attorney, Agent, or Firm*—Marger Johnson & McCollom, P.C.

[57] ABSTRACT

A tool including a nozzle for providing a high speed sheet of water wherein a generally circular pressurized stream of water is accelerated through a reduced area and reformed into a high-speed water sheet. The tool may include a reservoir for holding liquid cleaners, and a port through which the liquid cleaner is introduced into the nozzle through a port in the nozzle.

23 Claims, 5 Drawing Sheets

HIGH SPEED WATER SHEET TOOL

BACKGROUND OF THE INVENTION

This patent application is a continuation-in-part of U.S. patent application Ser. No. 08/919,860, filed Aug. 27, 1997, now abandoned, which claimed priority from provisional patent application Ser. No. 60/042,181, filed Apr. 2, 1997.

This invention relates to an apparatus for generating a high speed water spray, and more particularly to an apparatus for generating a high-speed sheet of water from water supplied at pressures typical of residential water systems.

Various nozzles are known for spraying water supplied by a typical residential water system. In known nozzles, the velocity of the water spray is limited to a degree that many tasks cannot be successfully accomplished without resorting to pressure washers. A need therefore remains for a tool for generating a high-speed water spray using water supplied at pressures typical of residual water systems, and provided by known nozzles.

SUMMARY OF THE INVENTION

The present invention meets the need for a higher velocity water spray, and further provides a water spray in the shape of a flat or slightly concave sheet of water.

This invention is embodied in a nozzle having a first hollow portion with an inlet, an outlet, and an upper wall extending therebetween. The outlet of the first portion is in communication with a second hollow portion having an inlet, an outlet, and an upper wall extending therebetween, the outlet of which has a second cross-sectional area smaller than the inlet of the first portion. The nozzle further includes a deflector which is in communication with the outlet of the second hollow portion. The deflector includes a first, generally flat surface for receiving the fluid stream from the second hollow portion outlet, and a second arcuate surface for forming the received fluid stream into a sheet. In the preferred embodiment, the upper wall of the first hollow portion, the upper wall of the second hollow portion, and the third portion form a continuous surface.

In one embodiment, a water spray nozzle according to the invention reform a fluid stream flowing at about 5.5 gallons per minute at a pressure of about 45 pounds per square inch into a sheet of fluid having a velocity greater than about 600 feet per second. In another embodiment, a water spray nozzle according to the invention reforms a fluid stream flowing at about 5.5 gallons per minute at a pressure of about 45 pounds per square inch into a sheet of fluid having a velocity greater than about 700 feet per second. In yet another embodiment, a water spray nozzle according to the invention reforms a fluid stream flowing at about 6.6 gallons per minute at a pressure of about 45 pounds per square inch into a sheet of fluid having a velocity greater than about 900 feet per second.

In yet another embodiment, the nozzle is mounted on the outlet of an elongate, hollow body. The elongate, hollow body includes an inlet, and preferably a valve to control water flowing into the body. The hollow body may be fitted with a fluid reservoir, a port connecting the reservoir with the hollow body, and a valve assembly for controlling the flow of fluid from the reservoir into the water flowing through the nozzle. The body may also be fitted with a brush assembly to supplement the cleaning action of the water stream. In another embodiment, the hollow body includes a flexible portion which can be manipulated to position the nozzle for access to otherwise unaccessible areas. These and other features of the invention will be described by reference to the drawings.

DETAILED DESCRIPTION OF THE PREFERRED EMBODIMENT

Figures 1, 2:
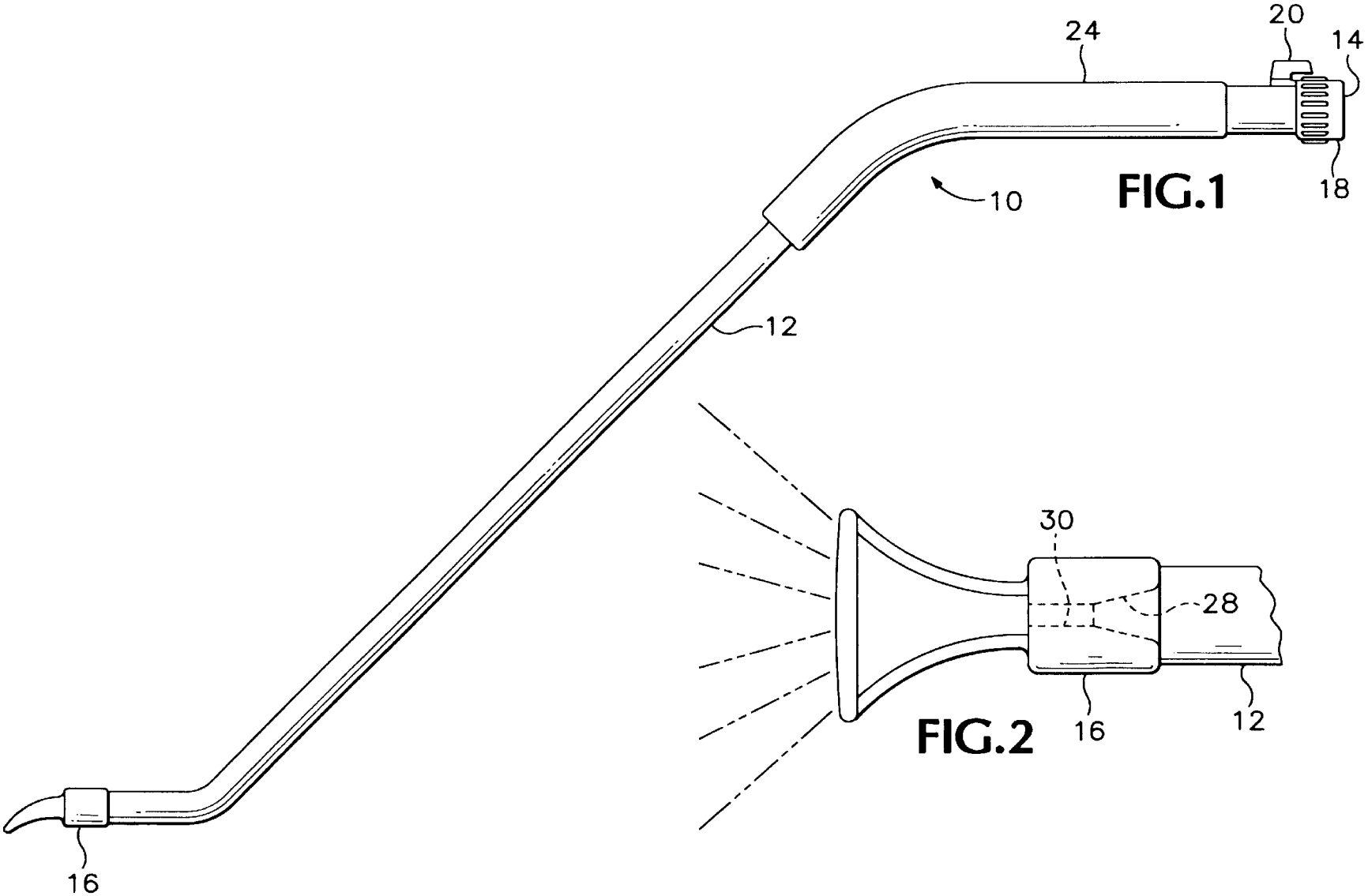
FIG. 1 is a side elevational view of a first embodiment of the invention.
FIG. 2 is a top plan view of the nozzle shown in FIG. 1.

Turning now to FIGS. 1 and 2, a preferred embodiment of the invention, indicated generally at 10 in FIG. 1, includes an elongate hollow body 12, a water inlet 14, and a nozzle assembly 16. Water inlet 14 includes a threaded female coupler 18 which is preferably sized to attach to a standard garden hose male end (not shown). A valve 20 is provided to enable a user to control the flow of water. In the preferred embodiment, valve 20 is a rotatable ball valve, but any suitable type of valve could be substituted.

Body 12 is preferably formed from a polymeric material such as ABS or polyethylene, although any suitable material could be used. Body 12 is preferably formed into an "S" shape which provides a convenient angle for gripping the handle portion, while at the same time positioning nozzle 16 at an advantageous angle. In an alternate embodiment shown in FIG. 3 and 4, a hollow body 12 includes a flexible portion 13 which permits repositioning of nozzle 16 to direct the water spray to less accessible places such as overhead gutters or vehicle fenderwells. In the embodiment shown, flexible body portion 12 is shown as a lower portion of body 24, but the invention is not limited thereto.

In either embodiment, the body is preferably fitted with a resilient, insulating, slip-resistant grip 24 as shown in FIG. 1. In one embodiment, grip 24 is a unitary polymeric foam grip adhered to body 10. Alternatively, grip 24 may a sheet or stranded material which has been wrapped around the body.

Figure 3:
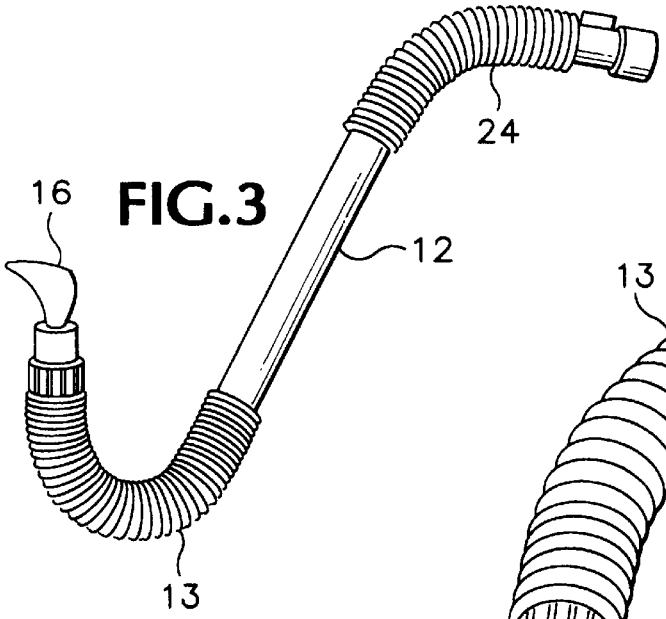
FIG. 3 is a perspective view of another embodiment wherein the hollow body includes a flexible portion.
Figure 4:
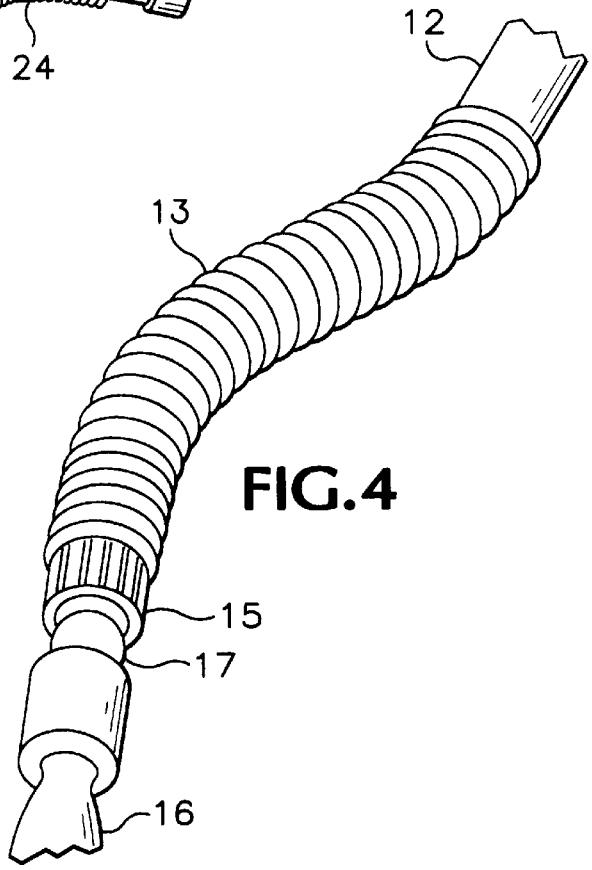
FIG. 4 is an enlarged partial perspective view of the embodiment shown in FIG. 7, further showing a quick-connect ball and socket mechanism.

In the embodiment of FIGS. 1, and 6–8, nozzle 16 is slid onto the end of body 12 and held in place with an adhesive. Nozzle 16 could also be secured by means of an interference fit, or by a rivet, screw, pin or any other suitable means of attachment. In the embodiment of FIG. 3, body 12 and nozzle 16 each include respective quick-connect couplings 15 and 17 which permit use of a variety of interchangeable nozzles. While a ball and socket quick-connect coupling is shown, it will be understood by those skilled in the art that other quick-connect type couplings could be used without departing from the spirit and scope of the claimed invention.

Figure 5:
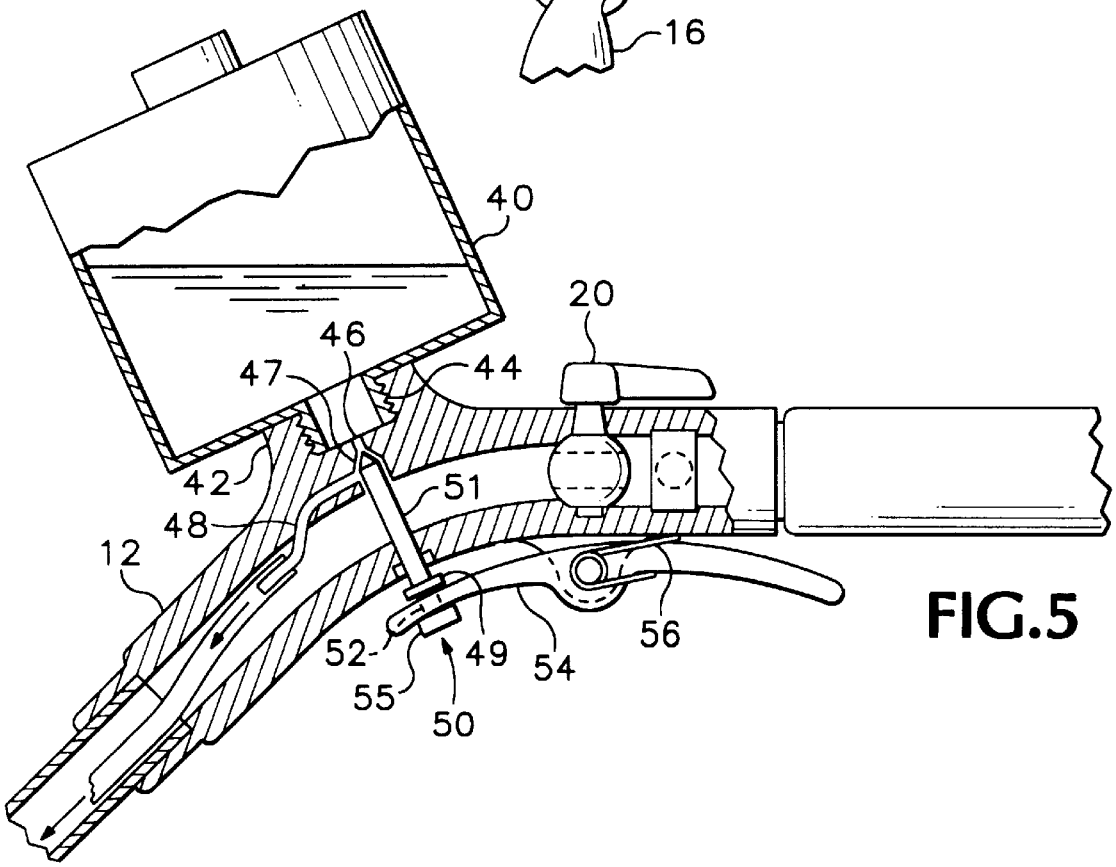
FIG. 5 is a partial cross-sectional side view of the invention showing in greater detail the water inlet valve, fluid reservoir and reservoir control valve.
Figure 7:
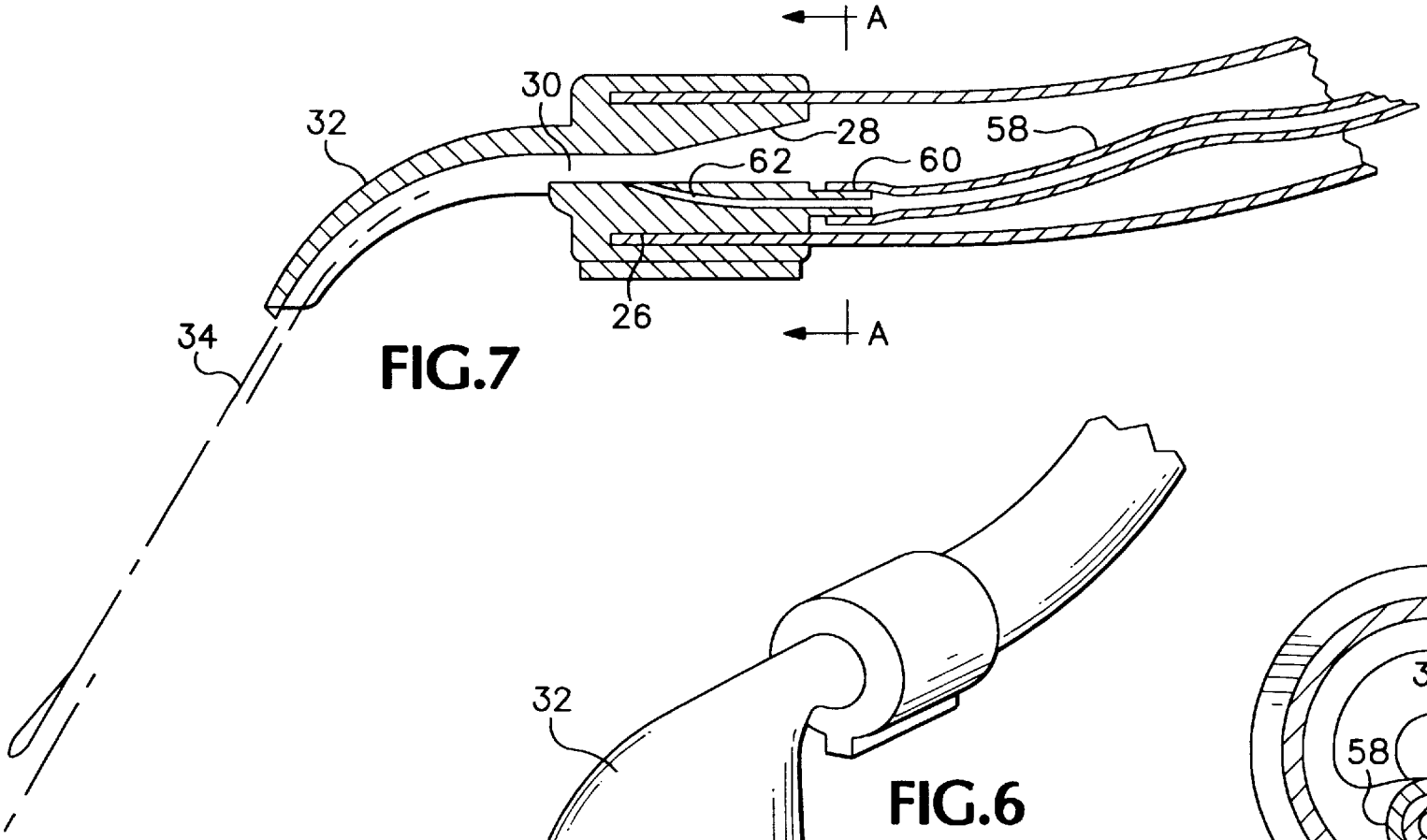
FIG. 7 is a side cutaway view of the nozzle shown in FIG. 6.

Turning now to FIG. 5, a preferred embodiment of the invention includes a liquid reservoir 40 is provided for containing a liquid soap, fertilizer, pesticide, or other liquid which is to be dispensed into the water stream. Reservoir 40 includes a nipple 44 which is engageable with a threaded boss 42 on body 12. Body 12 includes port 46 which is in communication with nipple 44, and which includes a tapered seat 47. Beneath tapered seat 47 is a lateral port 48 which is in communication with the hollow portion of body 12. A valve assembly 50 is provided which includes a needle valve 51. The upper portion of needle valve 51 is inserted through hole 52 and into the lower portion of port 46. An O-ring 49 seals the annulus between needle valve 51 and hole 52. The lower portion of needle valve 51 is retained by flanges 54 and 55 in a hole formed in one end of a pivoting handle 54. Valve 51 is normally biased upwardly by spring 56 into sealing engagement with tapered seat 47. Handle 54 is operable to open and close needle valve 51. Lateral port 48 is in communication with a nipple 56 which extends into the hollow center of body 12. A tube 58 is connected to nipple 56 and extends along the length of body 12. Tube 58 is preferably a flexible polymeric tube, but could also be a rigid preformed tube, or could be integrally formed with the body 12. The opposite end of tube 58 is connected to a nipple 60 which communicates with port 62 (FIG. 7). Port 62 terminates at its opposite end in a portion of the nozzle wherein the water stream has been accelerated and in which the resulting venturi effect leads to a reduced liquid pressure. The combination of the elevation difference between reservoir 40 and nozzle 16, when in their normal relative positions, and the venturi effect at the outlet of port 62 creates a pressure differential therebetween. As a result of the pressure differential, when needle valve 51 is opened liquid from reservoir 40 flows through lateral port 48, tube 58, and port 62, and is discharged into the water stream. The flow rate of liquid from reservoir 40 can be varied by partially or fully opening needle valve 51 as needed.

Figure 6:
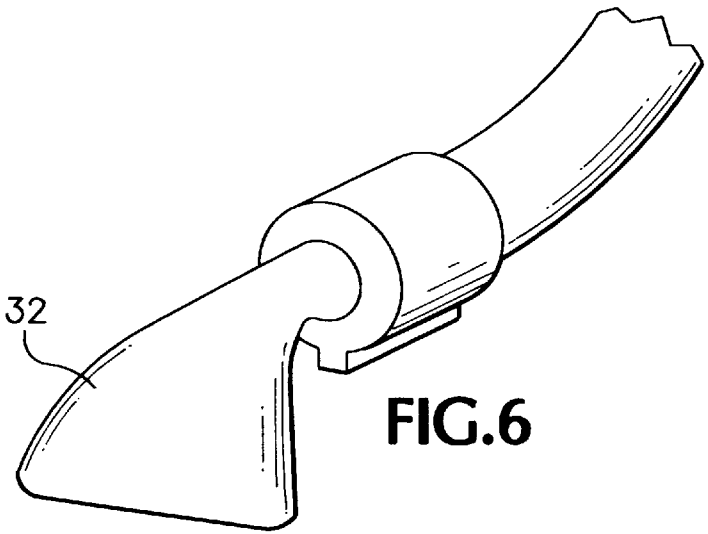
FIG. 6 is a perspective view of the nozzle shown in FIG. 1.
Figure 8:
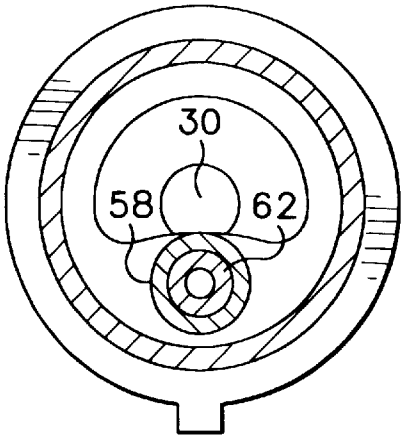
FIG. 8 is a cross-sectional view of the nozzle along line A—A in FIG. 7.

Turning now to FIGS. 6–8, nozzle assembly 16 will be described in greater detail. In the preferred embodiment, nozzle 16 is a unitary molded design formed from ABS, although other materials, including other polymeric materials, could also be used. In the preferred embodiment, nozzle 16 includes a socket 26 for receiving the lower end of body 12, which is additionally secured by a suitable adhesive. In the embodiment of FIG. 2, nozzle 16, a quick-connect fitting would be fitted rather than socket 26. In either embodiment, water enters nozzle 16 through conical section 28 and is accelerated as the diameter of section 28 is reduced. The accelerated water stream exits section 28 and passes through cylindrical section 30. In one embodiment, the water stream exiting section 30 has been accelerated to a velocity which is about 4 times that of its velocity when entering inlet 14. In one novel aspect of the invention, the accelerated, round water stream leaving section 30 is maintained in contact with deflector 32, a portion of which is continuous with the upper inner wall of sections 28 and 30. As the round water stream flows along deflector 32, it flows along deflector 32, and is reshaped into a sheet of water 34 and redirected downwardly. In the preferred embodiment, water sheet 34 is formed into a slightly concave sheet. The water sheet preferably breaks contact with the deflector approximately 3/16" from the forward edge thereof to prevent curling of the water sheet around the end of the deflector. The forward edge of the deflector also serves to prevent marring or disfigurement of the surface of the deflector which forms the water sheet, thereby helping to ensure the integrity and velocity of the water sheet. This aspect of the invention represents an improvement over the prior art in that the water stream is reshaped from a round water stream without frontally impacting a diffuser or the like, which applicant has recognized causes a significant reduction in water velocity in prior art nozzles. By maintaining the accelerated water stream in continuous, non-impacting contact with deflector 32, a water sheet is produced at a velocity which cannot be achieved with prior art nozzles operating at typical residential water pressure levels. The following table presents the water velocities achieved with the preferred embodiment of the invention, wherein the diameter of section 30 is 3/8".

| Pressure, PSI | Nozzle Flow Rate, GPM | Velocity, Ft/Sec. | Nozzle Flow Rate, GPM | Velocity Ft/Sec. | Approximate Velocity In 5/8 In. Hose, Ft/Sec/ |
|---|---|---|---|---|---|
| 45 | 5.5 | 736 | 6.6 | 943 | 70 |
| 40 | 4.9 | 649 | 6.2 | 891 | 65 |
| 30 | 4.5 | 599 | 5.3 | 770 | 60 |
| 20 | 3.4 | 463 | 4.9 | 633 | 50 |
| 10 | 3.3 | 438 | 3.0 | 440 | 40 |

These velocities are well above those which can be achieved with conventional nozzles.

Figure 9:
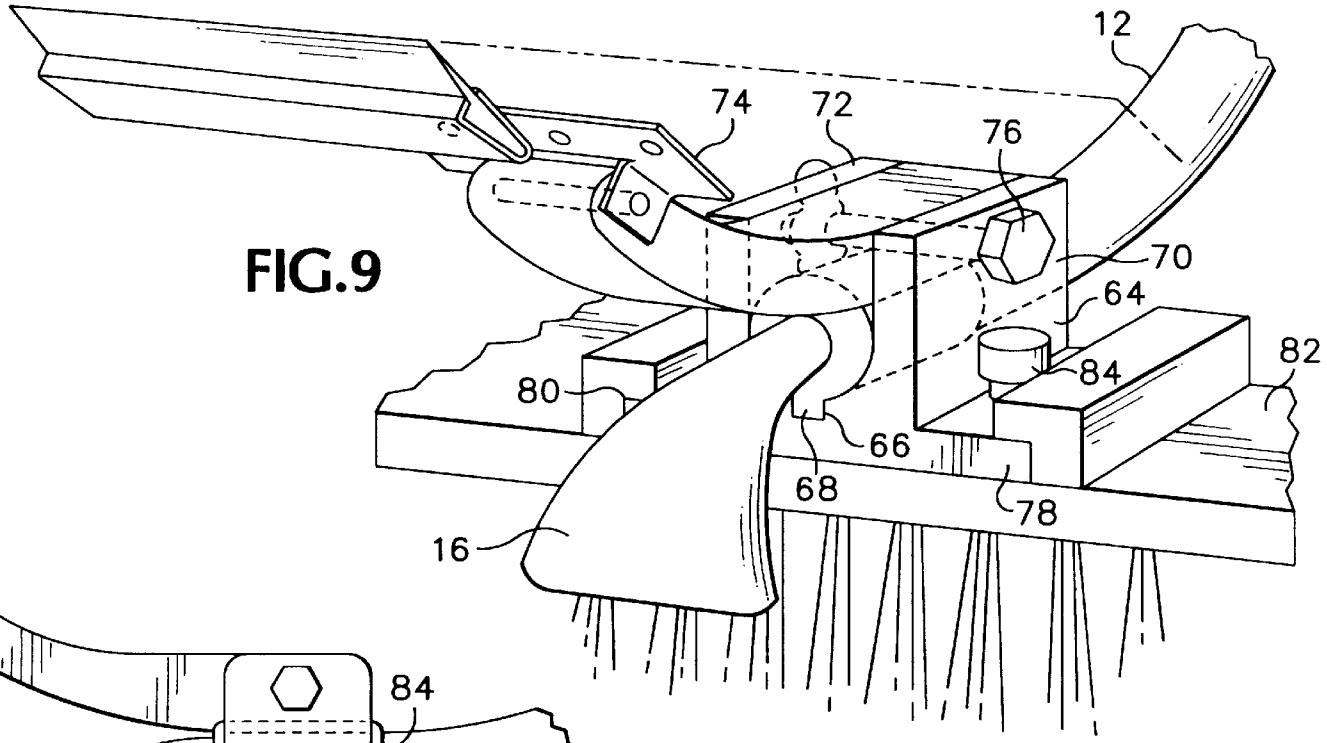
FIG. 9 is a partial perspective view of one embodiment of the invention showing a detachable brush and squeegee assembly.
Figure 10:
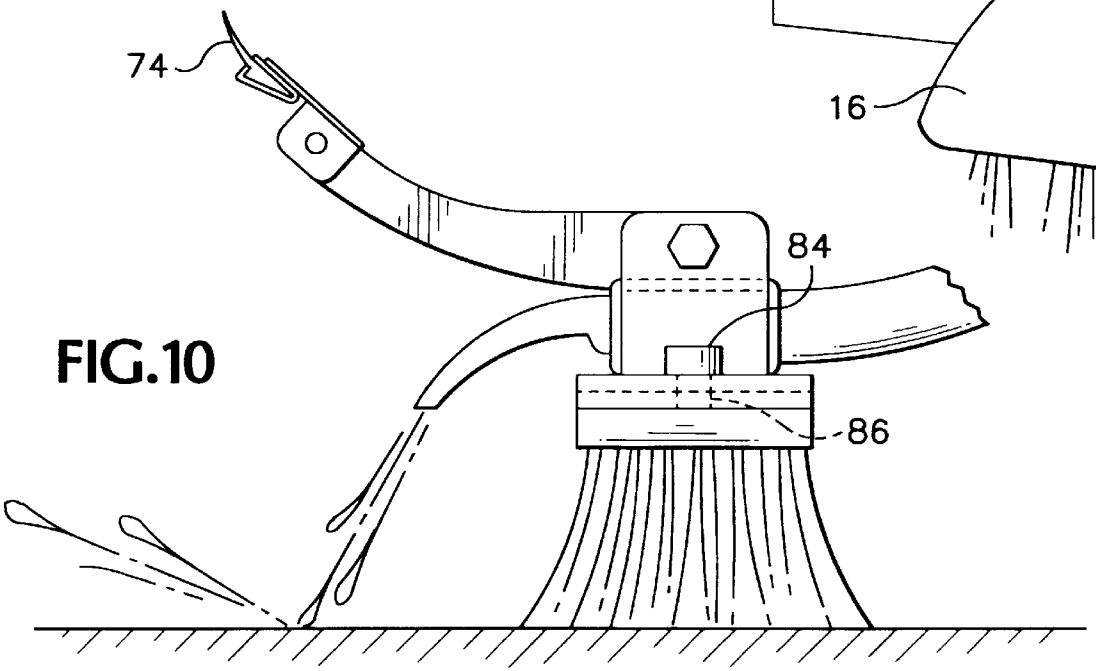
FIG. 10 is a side view of the embodiment shown in FIG. 9.

In another embodiment of the invention shown in FIGS. 9 and 10, a mounting adapter 64 is mounted nozzle. Mounting adapter 64 includes a channel 66 which receives a corresponding boss 68 formed in nozzle 16, and upwardly extending side walls 70 and 72. A squeegee 74 is fitted between side walls 70 and 72, and is secured in place by bolt 76. Mounting adapter 64 includes flanges 78 and 80 onto which optional brush attachment 82 can be removeably mounted. Pin 84 is provided to secure brush attachment 82 in place. Pin 84 is may have a threaded lower portion which is engageable with a corresponding threaded hole 86 in the brush attachment, or may be an unthreaded pin which is insertable into an unthreaded hole in the brush attachment.

Figure 11:
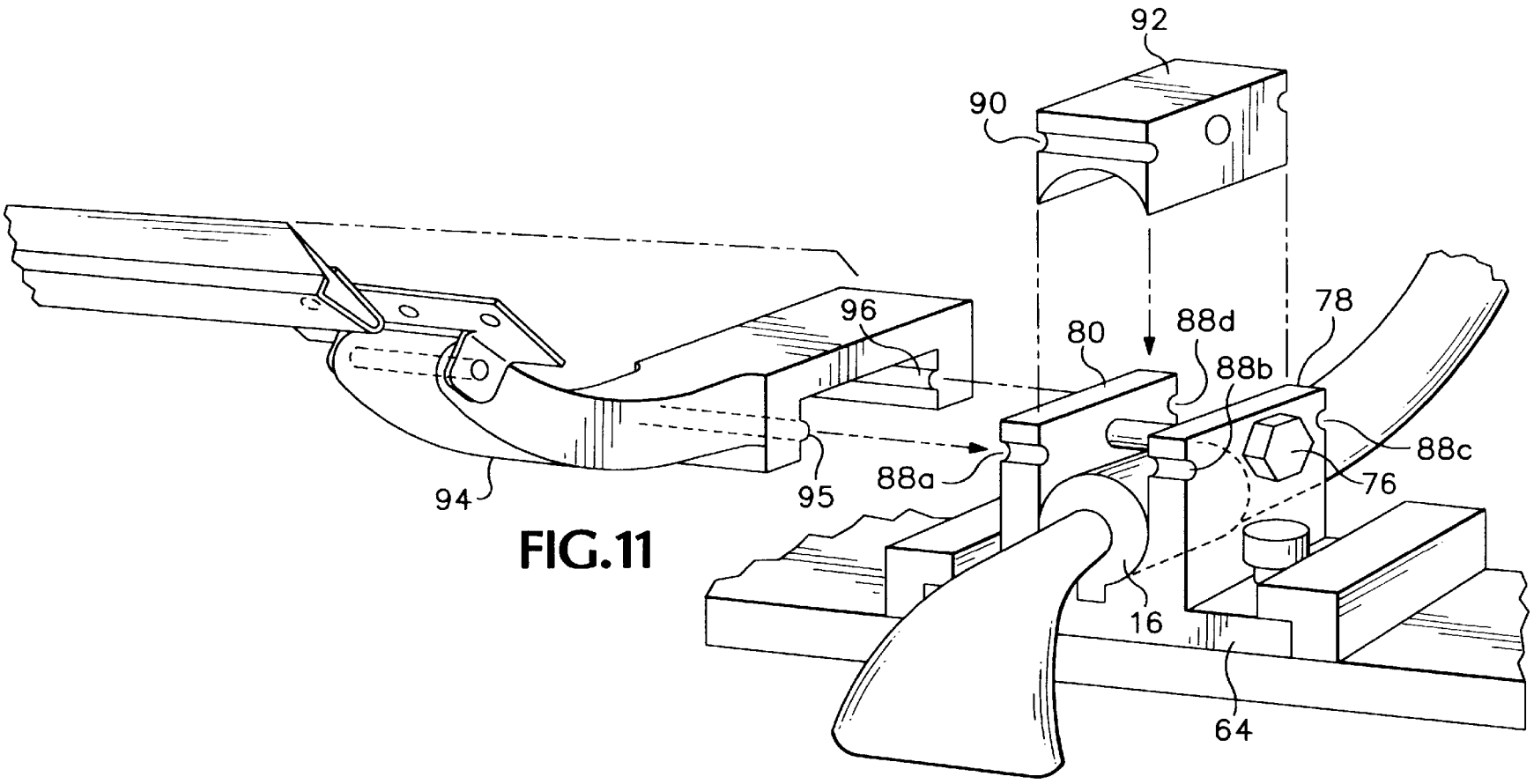
FIG. 11 is a partial perspective view showing a second embodiment of a detachable brush assembly.

In yet another embodiment as shown in FIG. 11, flanges 78 and 80 include notches 88*a*–88*d*. A spacer 92 is fitted between and secured to flanges 78 and 80, and includes transverse channels 90. A squeegee attachment 94 includes raised portions 95 and 96 which are slidably engageable with notches 88*a–d* and channels 90 and 92 for mounting the squeegee onto the assembly. Other attachments having similar raised portions 95 and 96 could also be used with equal utility.

Having described and illustrated the principles of the invention in a preferred embodiment thereof, it should be apparent that the invention can be modified in arrangement and detail without departing from such principles.

I claim:

1. A water spray tool comprising:

a body;

a nozzle mounted on the body and having first and second hollow portions and a third portion;

the first hollow portion having an inlet, an outlet, and an upper wall extending therebetween, the outlet having a first cross-sectional area;

the second hollow portion having an inlet, an outlet, and an upper wall extending therebetween, the inlet in communication with the outlet of first enclosed portion, and the outlet having a second, smaller cross-sectional area;

the third portion in communication with the outlet of the second hollow portion, the third portion comprising a first surface for receiving a fluid stream from the second hollow portion outlet, and a second surface for forming the received fluid stream into a sheet of fluid;

a vessel mounted on a first portion of the body;

first surfaces defining a first port in the nozzle and a conduit in communication with the nozzle, and the vessel, wherein the conduit is in communication with the nozzle, and the vessel comprises surfaces defining a second and third ports in the body, the second port in communication with the vessel, and the third port in communication with the second port, the conduit connecting the first and third ports;

a valve having a portion interposed between the second and third ports comprising a valve seat interposed between the second and third ports;

a valve member operable between a first position sealingly engaged with the valve seat and a second position spaced apart from the valve seat, said valve member comprising an elongate body slidingly disposed in the water spray tool body;

a first portion sealingly engageable with the valve seat; and second surfaces interlockingly engaging the elongate body to the valve operating member, said second surfaces defining a hole in the valve operating member, a portion of the elongate body being disposed in the hole in the valve operating member; and flanges located on the elongate body, above and below the valve-operating member.

2. A water spray tool according to claim 1 wherein the second hollow nozzle portion defines a first fluid flow direction, and wherein the first surface is essentially parallel thereto.

3. A water spray tool according to claim 1 wherein the second surface is curved.

4. A water spray tool according to claim 1 wherein the upper wall of the first hollow nozzle portion, the upper wall of the second hollow nozzle portion, and the third nozzle portion comprise a continuous surface.

5. A water spray tool according to claim 4 wherein the continuous surface is adapted to continuously contact a fluid stream passing through the nozzle.

6. A water spray tool according to claim 1 wherein the first, second and third nozzle portions are adapted to form a fluid stream flowing at a rate of at least about 5.5 gallons per minute at a pressure of at least about 45 pounds per square inch into a sheet of fluid having a velocity greater than about 600 feet per second.

7. A water spray tool according to claim 1 wherein the first, second and third nozzle portions are adapted to form a fluid stream flowing at a rate of at least about 5.5 gallons per minute at a pressure of a rate of at least about 45 pounds per square inch into a sheet of fluid having a velocity greater than about 700 feet per second.

8. A water spray tool according to claim 1 wherein the valve is normally biased toward its first position.

9. A water spray tool according to claim 1 wherein the first, second and third nozzle portions are adapted to form a fluid stream flowing at a rate of at least about 6.6 gallons per minute at a pressure of a rate of at least about 45 pounds per square inch into a sheet of fluid having a velocity greater than about 900 feet per second.

10. A water spray tool according to claim 1 wherein the first, second and third nozzle portions are adapted to form a fluid stream flowing at a rate of at least about 4.9 gallons per minute at a pressure of a rate of at least about 40 pounds per square inch into a sheet of fluid having a velocity greater than about 500 feet per second.

11. A water spray tool according to claim 1 wherein the first, second and third nozzle portions are adapted to form a fluid stream flowing at a rate of at least about 4.9 gallons per minute at a pressure of a rate of at least about 40 pounds per square inch into a sheet of fluid having a velocity greater than about 600 feet per second.

12. A water spray tool according to claim 1 which further comprises a valve mounted on the body and which is operable to control a flow of fluid through the body of water spray tool.

13. A water spray tool according to claim 1 which further comprises a valve for controlling a flow of liquid from the vessel to the water spray tool.

14. A water spray tool according to claim 1 further comprising a hollow body having a flexible portion.

15. A water spray tool according to claim 1 further comprising the body lower end having a first coupler and the nozzle having a second coupler removably engageable with the first coupler.

16. A water spray tool according to claim 1 which further comprises;

the nozzle having a raised portion;

a mounting bracket including a bottom wall having a channel, and first and second flanges extending upwardly from the bottom wall;

the mounting bracket removeably mounted on the nozzle and the nozzle raised portion received in the mounting bracket bottom wall channel.

17. A water spray tool according to claim 16 further comprising at least one cleaning implement mounted on the water spray tool.

18. A water spray tool according to claim 17 wherein the cleaning implement includes first and second channels, and respective first and second portions of the mounting bracket slidingly received therein.

19. A water spray tool according to claim 17 wherein the mounting bracket includes first and second channels, and wherein respective first and second portions of the cleaning implement are slidingly received therein.

20. A water spray tool according to claim 19 wherein the mounting bracket includes a spacer between the first and second flanges, the mounting bracket having surfaces defining said first and second channels.

21. A water spray tool according to claim 16 wherein at least one cleaning implement mounted on the water spray tool is selected from the group consisting of a brush, a squeegee, and a sponge.

22. A water spray tool according to claim 1 further comprising:

a spring urging the valve toward its first position;

a valve operating member connected to the valve and operable to move the valve between its first and second position.

23. A water spray tool according to claim 22 wherein the valve operating member is pivotally connected to the body, and wherein the spring bears on the valve operationg member.

* * * * *